US008016955B2

(12) United States Patent
Park et al.

(10) Patent No.: US 8,016,955 B2
(45) **Date of Patent: *Sep. 13, 2011**

(54) MAGNESIUM BASED AMORPHOUS ALLOY HAVING IMPROVED GLASS FORMING ABILITY AND DUCTILITY

(75) Inventors: Eun Soo Park, Gyeonggi-do (KR); Men Hua, Seoul (KR); Do Hyang Kim, Seoul (KR); Hye Jung Chang, Seoul (KR); Ju Yeon Lee, Daejeon (KR); Joon Seok Kyeong, Seoul (KR)

(73) Assignee: Yonsei University, Seoul (KR)

( * ) Notice: Subject to any disclaimer, the term of this patent is extended or adjusted under 35 U.S.C. 154(b) by 459 days.

This patent is subject to a terminal disclaimer.

(21) Appl. No.: 11/151,420

(22) Filed: Jun. 14, 2005

(65) Prior Publication Data

US 2005/0279427 A1 Dec. 22, 2005

(30) Foreign Application Priority Data

Jun. 14, 2004 (KR) ..... 10-2004-0043453

(51) Int. Cl.
*C22C 45/00* (2006.01)
*C22C 23/00* (2006.01)

(52) U.S. Cl. ..... 148/403; 420/402; 420/405

(58) Field of Classification Search ..... 148/403; 420/402–414

See application file for complete search history.

(56) References Cited

U.S. PATENT DOCUMENTS

| | | | | | |
|---|---|---|---|---|---|
| 4,990,198 | A | * | 2/1991 | Masumoto et al. | 148/403 |
| 5,250,124 | A | * | 10/1993 | Yamaguchi et al. | 148/403 |
| 5,304,260 | A | * | 4/1994 | Aikawa et al. | 148/403 |
| 5,348,591 | A | * | 9/1994 | Masumoto et al. | 148/403 |
| 5,350,468 | A | * | 9/1994 | Masumoto et al. | 148/561 |
| 5,711,363 | A | * | 1/1998 | Scruggs et al. | 164/113 |
| 6,027,586 | A | * | 2/2000 | Masumoto et al. | 148/561 |

FOREIGN PATENT DOCUMENTS

| | | | |
|---|---|---|---|
| CN | 1403617 | * | 3/2003 |
| JP | 2001-254157 | * | 9/2001 |

OTHER PUBLICATIONS

H. Men and D.H. Kim. Fabrication of ternary Mg-Cu-Gd bulk metallic glass with high glass-forming ability under air atmosphere. J. Mater. Res. vol. 18, No. 7, Jul 2003, p. 1502-1504.*

H. Men et al Glass formation and crystallization behavior in Mg65Cu25Y10-xGdx (x=0,5,10) alloys. Journal of Non-Crystalline Solids. 337 (2004, online May 6, 2004) 29-35.*

The Effect of Ag addition on the glass-forming ability of Mg-Cu-Y metallic glass alloys. Journal of Non-Crystalline Solids 279 (2001) p. 154-160.*

(Continued)

*Primary Examiner* — George Wyszomierski
*Assistant Examiner* — Mark L Shevin
(74) *Attorney, Agent, or Firm* — Rosenberg Klein & Lee

(57) ABSTRACT

Disclosed is a magnesium based amorphous alloy having a good glass forming ability and ductility. The Mg based amorphous alloy has a composition range of $Mg_{100-x-y}A_xB_y$ where x and y are respectively $2.5 \leqq x \leqq 30$, $2.5 \leqq y \leqq 20$ in atomic percent. Here, A includes at least one element selected from the group consisting of Cu, Ni, Zn, Al, Ag, and Pd, and B includes at least one element selected from the group consisting of Gd, Y, Ca, and Nd.

2 Claims, 10 Drawing Sheets

OTHER PUBLICATIONS

E.S. Park et al. Mg-rich Mg-Ni-Gd ternary bulk metallic glasses with high compressive specific strength and ductility. J. Mater. Res. vol. 22, No. 2, Feb. 2007, p. 334-338.*

X.K. Xi et al. Glass-forming Mg-Cu-RE (RE = Gd, Pr, Nd, Tb, Y, and Dy) alloys with strong oxygen resistance in manufacturability. Journal of Non-Crystalline Solids 344 (2004) p. 105-109.*

G. Yuan et al. Structural relaxation, glass forming ability and mechanical properties of Mg-Cu-Ni-Gd alloys, Journal of Non-Crystalline Solids, vol. 351, (2005), p. 729-735.*

English translation of Inoue et al—JP 2001-254157, published Sep. 18, 2001, 6 pages.*

G. Yuan and A. Inoue, Formation, Thermal Stability and Mechanical Properties of Mg-Cu-Gd-M (M=Ag,Ni) Base Bulk Glassy Alloys, Collected Abstracts of the 2004 Spring Meeting of Japan Institute of Metals, p. 372, article 772, published Mar. 30, 2004.*

* cited by examiner

MAGNESIUM BASED AMORPHOUS ALLOY HAVING IMPROVED GLASS FORMING ABILITY AND DUCTILITY

CROSS REFERENCE TO RELATED APPLICATION

This application claims priority under 35 USC §119 to Korean Patent Application No. 2004-0043453, filed on 14 Jun. 2004, the contents of which are incorporated herein by reference in their entirety.

BACKGROUND OF THE INVENTION

1. Field of the Invention

The present invention relates generally to a magnesium based amorphous alloy. More specifically, the invention relates to a Mg-based amorphous alloy, which has basically a good glass forming ability, along with an improved ductility.

2. Background of the Related Art

In general, a magnesium alloy is one of lightweight alloys having a high strength-to-weight ratio. The Mg alloy has an excellent vibration, impact, and electromagnetic wave absorbing abilities, a good electrical and heat conductivity, and an enhanced fatigue impact resistance at elevated temperature. Thus, it has a broad range of applications as a lightweighting material, for example, for automotive parts, transportation means, defense industry, and general machinery.

However, mostly crystalline Mg alloys have been used. In order that the Mg-based alloy can be employed for applications necessitating high mechanical properties, a Mg-based amorphous alloy needs to be developed, which is known to have an improved tensile strength, toughness and corrosion-resistance, relative to the conventional crystalline Mg-based alloys.

Thus, up until now, various types of Mg-based amorphous alloys have been proposed as follows.

Examples for a binary Mg-based amorphous alloy include Mg—Ca, Mg—Ni, Mg—Cu, Mg—Zn, Mg—Y, or the like. In addition, a tertiary Mg-based amorphous alloy system is exemplified by Mg—Cu—(Si, Ge, Ln, Y), Mg—Ni—(Si, Ge, Ln), Mg—Zn—(Si, Ge, Ln), Mg—Ca—(Al, Li, Si, Ge, M), Mg—Al-(Ln, Zn) and the like, where Ln is a lanthnide and M is a transition metallic element (Ni, Cu, Zn).

Conventionally, these Mg-based amorphous alloys can be manufactured only in the form of a ribbon having a thickness of several tens of microns or in the powder form, mostly using a rapid solidification method such as a melt spinning method, a splat quenching method, and a liquid atomization method. Thus, there have been lots of limitations in their applications.

Furthermore, recently-developed Mg-based bulk amorphous alloys embrace limitations in their practical use, similarly since they can be manufactured in a bulk form having a diameter of below 4 mm using an injection casting process under vacuum atmosphere. Also, the vacuum atmosphere leads to an increase in the manufacturing cost thereof and a decrease in the production efficiency therefor.

In addition, most of the conventional Mg-based amorphous alloys exhibit a brittle fracture behavior without plastic deformation after the elastic limit thereof, and thus have a limited applicability. In order to overcome these limitations in the conventional Mg-based amorphous alloy, that is, to provide a plastic deformation property at room temperature, extensive research and developments have been carried out. For example, a third element is added to the amorphous matrix, or a heat treatment is applied, to form a composite material so as to have a plastic property, or a post-treatment after forming an amorphous phase is performed to thereby provide a plastic characteristic to the amorphous material.

However, in order to provide a plastic deformation characteristic, research on the basis of thermodynamic and kinetic consideration (boundary condition of amorphous/crystalline) of amorphous-formation has been barely performed. Particularly, even appropriate standards or criteria for general purposes have not been produced yet.

SUMMARY OF THE INVENTION

Therefore, the present invention has been made in view of the above problems in the art, and it is an object of the present invention to provide a Mg-based amorphous alloy having a good glass forming ability, which contains metallic elements capable of enhancing the glass forming ability thereof, and can be cast in the air atmosphere through a common mold casting process.

Another object of the invention is to provide a Mg-based amorphous alloy, which has a good ductility through an alloy design capable of using the inherent magnesium characteristics.

A further object of the invention is to provide a Mg-base amorphous alloy having an improved strength, relative to commercial Mg alloys.

To accomplish the above object, according to one aspect of the present invention, there is provided a magnesium based amorphous alloy having a good glass forming ability and ductility. The Mg-based amorphous alloy has a composition range of $Mg_{100-x-y}A_xB_y$ where x and y are respectively $2.5 \leqq x \leqq 30$, $2.5 \leqq y \leqq 20$ in atomic percent, wherein A includes at least one element selected from the group consisting of Cu, Ni, Zn, Al, Ag, and Pd, and B includes at least one element selected from the group consisting of Gd, Y, Ca, and Nd.

The Mg-based amorphous alloy is capable of being manufactured in a bulk amorphous form, using a die casting process, an injection casting process, or a high-pressure squeeze casting in an air atmosphere.

According to an embodiment of the invention, x is $10 \leqq x \leqq 30$ and y is $2.5 \leqq y \leqq 15$.

According to an embodiment of the invention, x is $2.5 \leqq x \leqq 20$ and y is $2.5 \leqq y \leqq 20$.

According to an embodiment of the invention, A includes Cu, and B includes Gd.

According to an embodiment of the invention, A includes Cu and Ag, and B includes Gd.

According to an embodiment of the invention, A includes Cu and Ni, and B includes Gd.

According to an embodiment of the invention, A includes Cu and Zn, and B includes Gd.

According to an embodiment of the invention, A includes Cu and Al, and B includes Gd.

According to an embodiment of the invention, A includes Cu and Ag, and B includes Y.

According to an embodiment of the invention, A includes Cu and Ni, and B includes Y.

According to an embodiment of the invention, A includes Cu and Zn, and B includes Y.

According to an embodiment of the invention, A includes Cu and Al, and B includes Y.

According to an embodiment of the invention, A includes Cu, Ni, Zn and Ag, and B includes Gd.

According to an embodiment of the invention, A includes Cu, Ni, Zn and Ag, and B includes Gd.

According to an embodiment of the invention, A includes Zn, and B includes Ca.

According to an embodiment of the invention, A includes Ni, and B includes Gd.

According to an embodiment of the invention, A includes Cu, and B includes Y.

According to an embodiment of the invention, A includes Cu, and B includes Nd.

According to an embodiment of the invention, A includes Ni, and B includes Nd.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
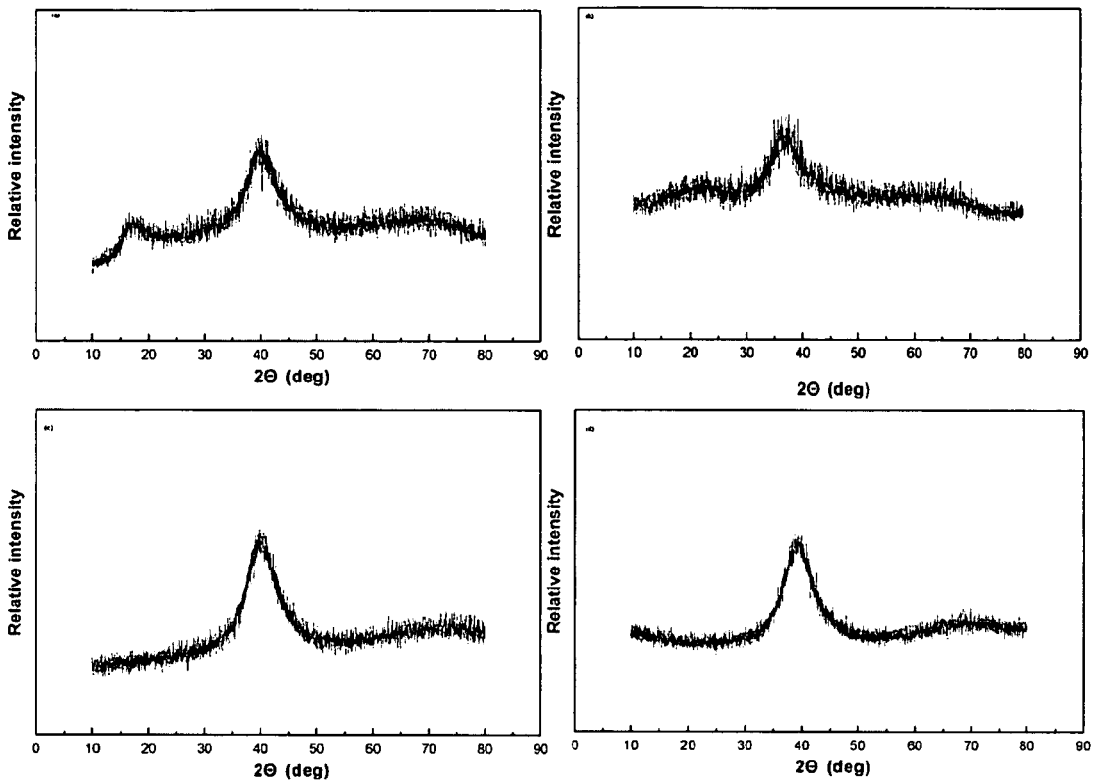
FIG. 1 is graphs showing X-ray diffraction results to evaluate the glass forming behavior for Mg-based amorphous alloys of the invention, which contain 10 atomic % of Gd and further contain (a) 25 atomic % Cu, (b) 25 atomic % of Al, (c) 25 atomic % of Ni, or (d) 25 atomic % of Zn respectively.

The preferred embodiments of the invention will be hereafter described in detail, with reference to the accompanying drawings.

A magnesium based amorphous alloy according to an embodiment of the invention has a composition range of $Mg_{100-x-y}A_xB_y$ where x and y are respectively $2.5 \leqq x \leqq 30$, $2.5 \leqq y \leqq 20$ in atomic percent, and provides a good glass forming ability and ductility. Here, A is at least one element selected from Cu, Ni, Zn, Al, Ag and Pd, and B is at least one element selected from Gd, Y, Ca and Nd.

In the Mg-based amorphous alloy of the invention, the x and y values are limited as described above for the following reasons.

If the constituent A and B are contained to less than 2.5 atomic %, the amorphous alloy can not obtain a close-packing effect, which is provided in a multi-component alloy system of three or more constituents, according to empirical principles on the amorphous formation, thereby failing to improve the glass forming ability. Thus, the content of A and B is preferred to be no less than 2.5 atomic % respectively.

In addition, if the A and B are contained to above 30 atomic % and 20 atomic % respectively, bulk amorphous formation is inhibited due to an increase in the melting point thereof, and the ductility to be inherently acquired from magnesium cannot be achieved. Accordingly, the contents of A and B are preferred to be no more than 30 atomic % and 20 atomic % respectively.

Furthermore, in order to further improve the glass forming ability of the Mg-based amorphous alloy of the invention, the content of the A constituent may be limited within a range of 2.5~20 atomic %. In order to further enhance the ductility thereof, the contents of A and B may be further limited to a range of 10~30 atomic % and 2.5~15 atomic %.

The Mg-based amorphous alloy of the invention has basically a good glass forming ability, and simultaneously provides an enhanced ductility in a certain specific Mg-rich region.

That is, according to the invention, in the Mg-rich region in the bulk amorphous region, the Mg-based amorphous alloy of the invention exhibits a plastic deformation characteristic in an amorphous state, due to the inherent contribution of magnesium to ductility.

Therefore, the Mg-based amorphous alloy of the invention has an excellent glass forming ability, along with ductility, thereby providing for a variety of applications.

The following examples are provided for a further understanding of the invention, but not intended to limit the invention.

EXAMPLES 1 TO 17

The examples 1 to 17 were carried out in order to explain the glass forming ability of the Mg-base amorphous alloy of the invention. Various alloys, including the examples 1 to 17 and the comparison examples 1 to 5, were prepared so as to have compositions listed in Table 2 and tested for the glass forming ability thereof.

In the Mg-based alloy of the invention, the alloying elements, which are added to the major constituent Mg, have a large atomic radius difference with Mg and a negative heat of mixing with Mg, as shown in Table 1. In addition, through addition of the above metallic elements, the supercooled liquid region is expanded, the packing density thereof is enhanced due to the multi-component of the alloy system, and the melting temperature thereof is lowered, thereby improving the glass forming ability and mechanical properties thereof.

TABLE 1

| | Mg | Cu | Ni | Al | Zn | Pd | Ag | Gd | Y | Ca | Nd |
|---|---|---|---|---|---|---|---|---|---|---|---|
| Atomic radius (A) | 1.6 | 1.28 | 1.24 | 1.43 | 1.38 | 1.37 | 1.44 | 1.80 | 1.78 | 1.97 | 1.82 |
| ** | 0 | −29 | −12 | −7 | −13 | −153 | −47 | −25 | −27 | −26 | −28 |

Note:
** Heat of mixing between Mg and other elements (KJ/g-at)

In Table 2, the compositions of the example alloys according to the invention and the comparison alloys are listed. All the alloys were prepared through a common die casting process in the air atmosphere and compared for their glass forming ability.

TABLE 2

| Division | Composition (at %) | $T_g$(K) | $T_x$(K) | $\Delta T_x$(K) | $T_{rg}$ | $d_{max}$(mm) |
|---|---|---|---|---|---|---|
| Example 1 | $Mg_{65}Cu_{25}Gd_{10}$ | 408 | 478 | 70 | 0.55 | ≧8 |
| Example 2 | $Mg_{65}Cu_{25}Gd_5Y_5$ | 420 | 482 | 62 | 0.57 | ≧6 |
| Example 3 | $Mg_{65}Cu_{15}Ag_{10}Gd_{10}$ | 416 | 459 | 43 | 0.58 | ≧7.5 |
| Example 4 | $Mg_{65}Cu_{15}Al_{10}Gd_{10}$ | 428 | 463 | 35 | 0.58 | ≧5 |
| Example 5 | $Mg_{65}Cu_{15}Ni_{10}Gd_{10}$ | 423 | 469 | 46 | 0.58 | ≧6 |
| Example 6 | $Mg_{65}Cu_{15}Zn_{10}Gd_{10}$ | 432 | 462 | 30 | 0.59 | ≧5 |
| Example 7 | $Mg_{65}Cu_{15}Ag_5Pd_5Gd_{10}$ | 430 | 472 | 42 | 0.58 | ≧10 |
| Example 8 | $Mg_{65}Cu_{15}Ag_{10}Pd_5Y_5$ | 435 | 474 | 39 | 0.58 | ≧6 |
| Example 9 | $Mg_{65}Cu_{15}Ag_{10}Y_2Gd_8$ | 420 | 464 | 44 | 0.615 | ≧9 |
| Example 10 | $Mg_{65}Cu_{15}Ag_{10}Y_4Gd_6$ | 424 | 467 | 43 | 0.622 | ≧8 |
| Example 11 | $Mg_{65}Cu_{15}Ag_{10}Y_8Gd_2$ | 428 | 472 | 44 | 0.620 | ≧7 |
| Example 12 | $Mg_{70}Zn_{25}Ca_5$ | 372 | 389 | 20 | 0.56 | ≧2 |
| Example 13 | $Mg_{75}Ni_{15}Gd_{10}$ | 452 | 495 | 43 | 0.58 | ≧4 |
| Example 14 | $Mg_{65}Cu_{25}Nd_{10}$ | 423 | 452 | 30 | 0.57 | ≧2 |
| Example 15 | $Mg_{65}Cu_{7.5}Ni_{7.5}Zn_5Ag_5Gd_{10}$ | 427 | 465 | 38 | 0.614 | ≧11 |
| Example 16 | $Mg_{65}Cu_{7.5}Ni_{7.5}Zn_5Ag_5Y_5Gd_5$ | 434 | 472 | 38 | 0.604 | ≧14 |
| Example 17 | $Mg_{65}Cu_{15}Ag_{10}Y_{10}$ | 428 | 469 | 41 | 0.634 | ≧6 |
| Comparison Example 1 | $Mg_{55}Cu_{35}Gd_{10}$ | 458 | 473 | 15 | 0.52 | <1 |
| Comparison Example 2 | $Mg_{73}Cu_{25}Gd_2$ | — | 421 | — | — | <1 |
| Comparison Example 3 | $Mg_{65}Cu_{25}Gd_5Nb_5$ | — | 505 | — | — | <1 |
| Comparison Example 4 | $Mg_{65}Cu_{15}Fe_{10}Gd_{10}$ | 435 | 454 | 19 | 0.51 | <1 |
| Comparison Example 5 | $Mg_{45}Cu_{15}Ni_{10}Gd_{30}$ | 471 | 494 | 23 | 0.48 | <1 |

In these examples, the raw material was melted using a high frequency induction furnace of argon atmosphere and the melt was cast into a copper mould having a conical shape to thereby form conical specimens having a length of 45 mm.

A copper mould can be used to manufacture an amorphous alloy, without necessity of a high cost facility, such as vacuum equipment, and a high level of atmosphere control, thereby easily obtaining a bulk amorphous phase.

Figure 2:
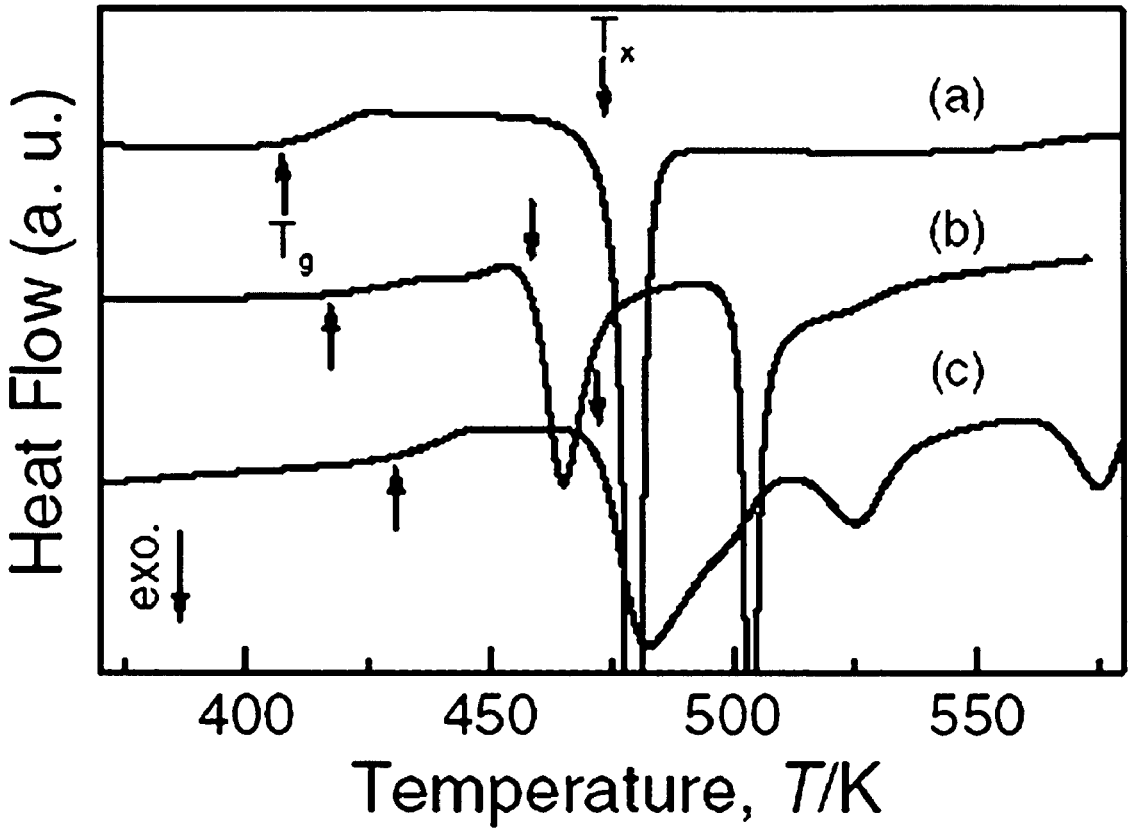
FIG. 2 is a graph showing the results of differential scanning calorimetry for Mg-based amorphous alloys of the invention, which contains 10 atomic % of Gd and further contain (a) 25 atomic % Cu, (b) 15 atomic % of Cu and 10 atomic % of Ag, or (c) 15 atomic % of Cu, 5 atomic % Ag, and 5 atomic % of Pd respectively.

With respect to the above-manufactured Mg-based amorphous alloys, the glass transition temperature $T_g$, the crystallization temperature $T_x$, and the melting temperature $T_m$ were measured using the differential scanning calorimetry, as shown in FIG. 2. Based on the above measurement, the supercooled liquid region $\Delta T_x$ ($=T_x-T_g$) and the reduced glass transition temperature $T_{rg}$ ($=T_g/T_m$) can be calculated, which are major parameters for evaluating the glass forming ability of alloys.

The bulk glass forming ability may be expressed using a maximum diameter $d_{max}$. In these examples, the specimens were cast using a copper mold of conical shape, and thus the diameter of the circular face in the cast conical specimen is regarded as the maximum diameter.

In order to evaluate the glass forming ability of the above-prepared bulk specimen, the exothermic heat values were compared with respect to the vertical cross-section of the bulk specimen and a specimen prepared in the form of a ribbon, using a differential scanning calorimeter. In addition, the presence of a halo pattern was confirmed for each specimen, using the X-ray diffraction analysis. The maximum diameters of the specimens, which were confirmed as an amorphous alloy, are listed in Table 2.

In general, if the maximum diameter ($d_{max}$) is above 1 mm, the alloy is determined as an amorphous alloy having a good glass forming ability.

Therefore, the Mg-based bulk amorphous alloy of the invention, which contains Cu, Ni, Zn, Al, Ag, Pd, Gd, Y, Ca and Nd and are cast into a metallic mold in the air atmosphere, has the $\Delta T_x$ value of above 20 K and the $T_{rg}$ value of above 0.55 respectively, and the maximum diameter ($d_{max}$) of above 5 mm. Thus, it is determined that these alloys prepared according to the invention have an excellent glass forming ability.

In addition, the alloy of example 17 can be manufactured in the form of bulk amorphous of up to 10 mm diameter, when using a high-pressure squeeze casting process.

FIGS. 1 to 5 show the results of analysis for the specimen having example compositions, which are listed in Table 2.

First, FIG. 1 is graphs showing X-ray diffraction results to evaluate the glass forming behavior for Mg-based amorphous alloys of the invention, which contains 10 atomic % of Gd and further contain (a) 25 atomic % Cu, (b) 25 atomic % of Al, (c) 25 atomic % of Ni, or (d) 25 atomic % of Zn respectively.

As shown in FIG. 1, it has been confirmed that the example alloys exhibit a halo pattern indicating the presence of amorphous phase and do not present any diffraction peak indicating a crystalline phase.

FIG. 2 is a graph showing the results of differential scanning calorimetry for Mg-based amorphous alloys of the invention, which contains 10 atomic % of Gd and further contain (a) 25 atomic % Cu, (b) 15 atomic % of Cu and 10 atomic % of Ag, or (c) 15 atomic % of Cu, 5 atomic % Ag, and 5 atomic % of Pd respectively.

Referring to FIG. 2, it can be seen that the Mg-based amorphous alloys of the invention have a supercooled liquid region of above 20 K over the entire composition range, which indicates the glass forming ability thereof.

Figure 3:
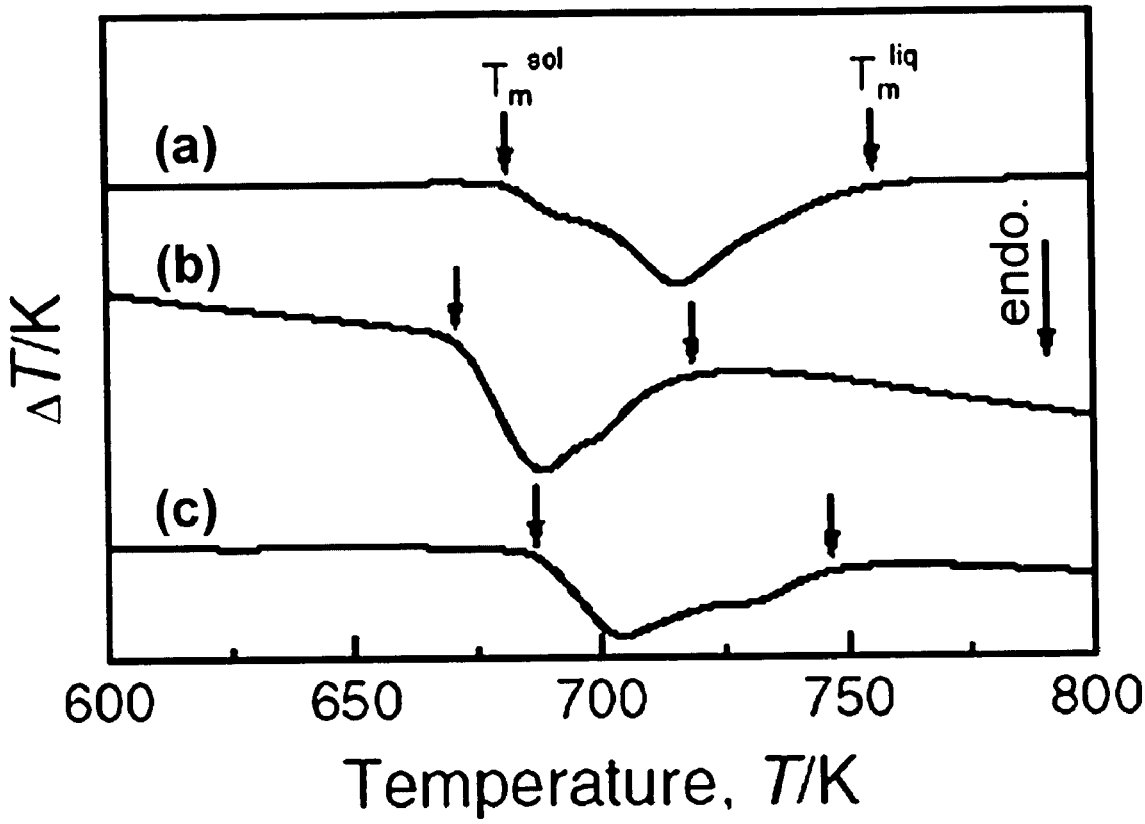
FIG. 3 is a graph showing the results of differential thermal analysis for Mg-based amorphous alloys of the invention, which contains 10 atomic % of Gd and further contain (a) 25 atomic % Cu, (b) 15 atomic % of Cu and 10 atomic % of Ag, or (c) 15 atomic % of Cu, 5 atomic % Ag, and 5 atomic % of Pd respectively.

FIG. 3 is a graph showing the results of differential thermal analysis for Mg-based amorphous alloys of the invention, which contains 10 atomic % of Gd and further contain (a) 25 atomic % Cu, (b) 15 atomic % of Cu and 10 atomic % of Ag, or (c) 15 atomic % of Cu, 5 atomic % Ag, and 5 atomic % of Pd respectively.

As can be seen in FIG. 3, the melting point thereof, which is one of the major parameters indicating glass forming ability, is no more than 800 K, and the $T_{rg}$ value, another parameter for the glass forming ability, is above 0.55. In general, the $T_{rg}$ value of 0.55 represents an excellent bulk glass forming ability.

Figure 4:
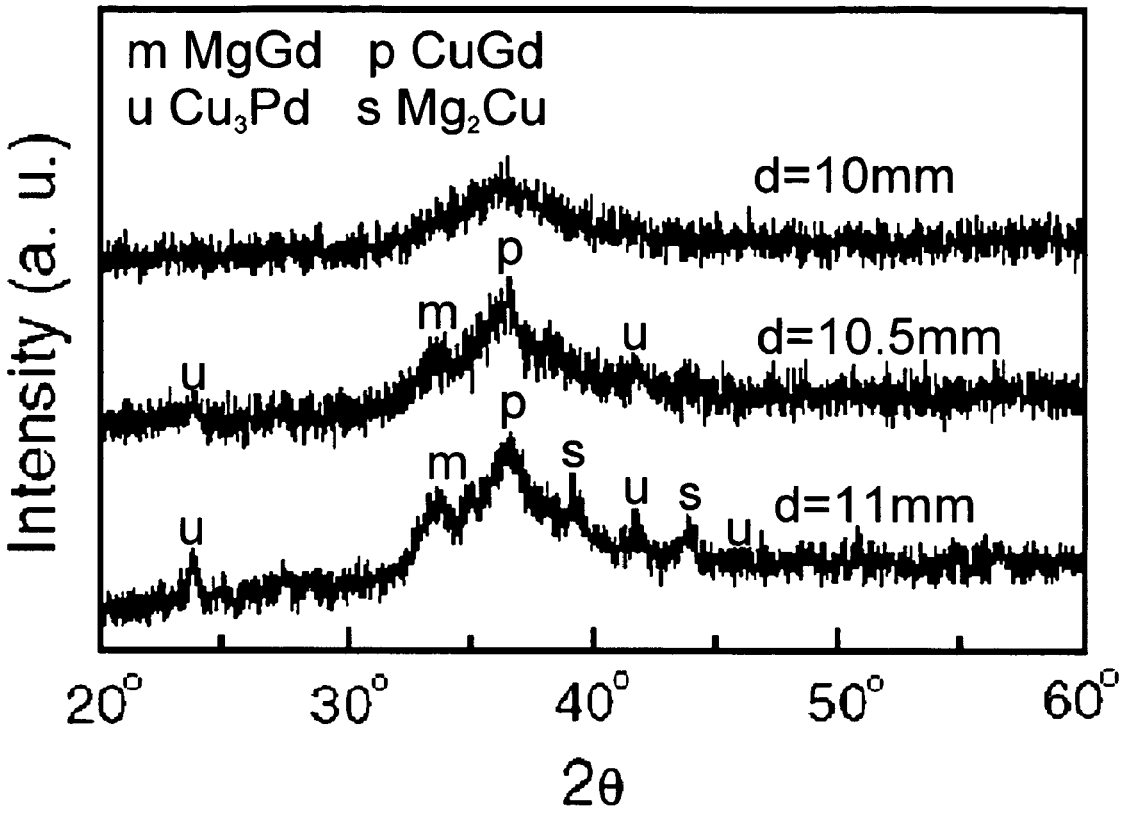
FIG. 4 is a graph showing X-ray diffraction results to evaluate the bulk glass forming behavior for Mg-based amorphous alloys of the invention, which contain 15 atomic % Cu, 5 atomic % of Ag, 5 atomic % of Pd, and 10 atomic % of Gd.

FIG. 4 is a graph showing X-ray diffraction results to evaluate the bulk glass forming behavior for Mg-based amorphous alloys of the invention, which contain 15 atomic % Cu, 5 atomic % of Ag, 5 atomic % of Pd, and 10 atomic % of Gd.

As shown in FIG. 4, it has been found that the Mg-based amorphous alloy containing 15 atomic % Cu, 5 atomic % of Ag, 5 atomic % of Pd and 10 atomic % of Gd is formed with a bulk amorphous phase, and a good bulk amorphous phase is formed up to 10 mm of the maximum diameter.

Thus, it can be seen, from the above analysis results, that the Mg-based amorphous alloys according to the invention has a good bulk glass forming ability.

Figure 5:
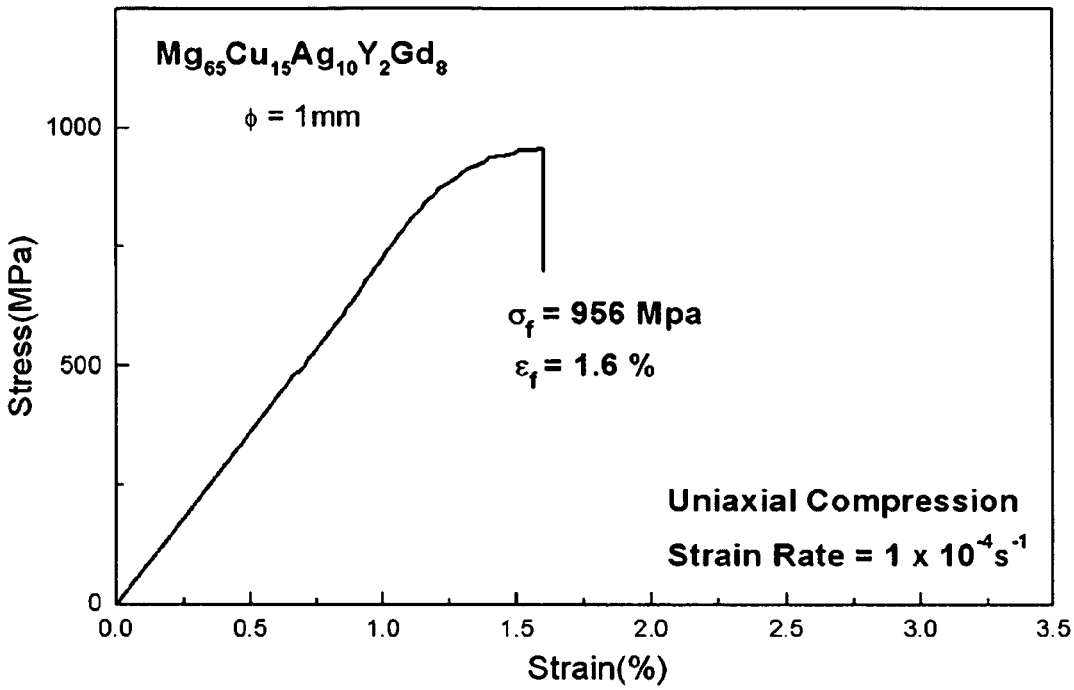
FIG. 5 is a graph showing the compression test result for a 1 mm-diameter rod specimen of the composition $Mg_{65}Cu_{15}Ag_{10}Y_2Gd_8$ among the Mg-based amorphous alloys according to the invention.

FIG. 5 is a graph showing the compression test result for a 1 mm-diameter rod specimen of the composition $Mg_{65}Cu_{15}Ag_{10}Y_2Gd_8$ among the Mg-based amorphous alloys according to the invention.

As shown in FIG. 5, the Mg-based bulk amorphous alloy of the invention has a compressive strength of 1 Gpa, which corresponds to more than three times of the conventional Mg alloys.

In view of the above result, it can be see that the Mg-based amorphous alloy of the invention can be applied to a structural material.

EXAMPLES 18 TO 27

The examples 18 to 27 were carried out in order to explain the ductile property of the Mg-base amorphous alloy of the invention. Various alloys, including the examples 18 to 27 and the comparison examples 6 to 10, were prepared so as to have compositions listed in Table 3 and tested for the mechanical properties.

In the examples 18 to 27, a rod-shape specimen for the mechanical test (compression test) was prepared using an injection casting process.

That is, in order to fabricate the rod specimen using the injection casting process, each composition listed in Table 3 is loaded inside a transparent quartz tube, the vacuum of which was about 20 cmHg, and melted using a high frequency induction furnace under argon gas atmosphere of about 7~9 KPa. Then, at the state where the melted alloy was held inside the quartz tube by means of the surface tension of the melted alloy, argon gas of about 50 KPa was injected into the quartz tube before the melted alloy was reacted with the quartz tube, while rapidly descending the quartz tube. In this way, the melted alloy was filled into a water-cooled copper mold, thereby producing a rod specimen having a length of 40 mm and a diameter of 1 mm.

The above-prepared rod specimen was cut so as to have a length of 2 mm and the compression test therefor was carried out at the strain rate of $1\times10^{-4}$/s.

The compositions of the above-prepared specimen and the test results therefor are listed in Table 3. As can be seen from the results in Table 3, it has been found out that the examples 18 to 27 exhibit an excellent plastic deformation characteristic of above 1%, while retaining an amorphous form due to increase in the Mg contents, or a composite form due to uniform precipitation of the competitive crystalline phase.

In contrast with the examples 18 to 27, the comparison example 6 ($Mg_{60}Cu_{35}Gd_5$) is compared to the case where the metallic element A of the invention is contained up to above 30%, and can be formed with a bulk amorphous phase of above 1 mm. However, it has a problem that the comparison example 6 exhibits a brittle fracture behavior without plastic deformation after the elastic range thereof.

The comparison examples 7 and 8 ($Mg_{60}Cu_{20}Gd_{20}$, $Mg_{55}Cu_{10}Ni_5Ag_{10}Gd_{10}Y_{10}$) are compared to the case where the metallic element B of the invention is contained up to above 15%, and can be formed with a bulk amorphous phase of above 1 mm. However, the comparison examples 7 and 8 exhibited a brittle fracture behavior without plastic deformation after the elastic range thereof.

The comparison example 9 ($Mg_{70}Y_{10}$) corresponds to the case where the metallic element A of the invention is contained up to less than 2.5%, and did not form an amorphous phase.

The comparison example 10 ($Mg_{70}Cu_{15}Ni_5Ag_{10}$) corresponds to the case where the metallic element B of the invention is contained up to less than 2.5%, and did not form an amorphous phase.

As can be seen from the above results, the Mg-based amorphous alloy of the invention has a good ductility, along with the high strength thereof, and thus provides a good resistance to rupture under stresses above the elastic limit thereof. Consequently, according to the invention, a high-strength and high-toughness Mg-based amorphous alloy having practical applications can be achieved.

TABLE 3

| Division | Composition (at %) | $\sigma_f$(GPa) | $\epsilon_f$(%) | Structure |
|---|---|---|---|---|
| Example 18 | $Mg_{80}Cu_{15}Gd_5$ | 848 | 5.52 | Amorphous |
| Example 19 | $Mg_{80}Cu_{10}Y_{10}$ | 908 | 3.02 | Amorphous |
| Example 20 | $Mg_{75}Cu_{15}Ni_5Zn_{2.5}Ag_{2.5}Gd_5Y_5$ | 864 | 2.91 | Amorphous |
| Example 21 | $Mg_{75}Ni_{10}Nd_{15}$ | 889 | 3.45 | Amorphous |
| Example 22 | $Mg_{75}Ni_{15}Gd_{10}$ | 837 | 3.25 | Amorphous |

TABLE 3-continued

| Division | Composition (at %) | $\sigma_f$(GPa) | $\epsilon_f$(%) | Structure |
|---|---|---|---|---|
| Example 23 | $Mg_{70}Ni_{15}Gd_{15}$ | 908 | 3.63 | Composite |
| Example 24 | $Mg_{85}Cu_{10}Gd_5$ | 712 | 7.22 | Composite |
| Example 25 | $Mg_{85}Cu_5Y_{10}$ | 586 | 14.1 | Composite |
| Example 26 | $Mg_{75}Zn_{20}Ca_5$ | 547 | 9.46 | Composite |
| Example 27 | $Mg_{85}Cu_5Zn_{2.5}Ag_{2.5}Gd_{2.5}Y_{2.5}$ | 623 | 6.78 | Composite |
| Comparison Example 6 | $Mg_{60}Cu_{35}Gd_5$ | 762 | 1.82 | Amorphous |
| Comparison Example 7 | $Mg_{60}Cu_{20}Gd_{20}$ | 733 | 1.74 | Amorphous |
| Comparison Example 8 | $Mg_{55}Cu_{10}Ni_5Ag_{10}Gd_{10}Y_{10}$ | 703 | 1.76 | Amorphous |
| Comparison Example 9 | $Mg_{90}Y_{10}$ | — | — | Crystalline |
| Comparison Example 10 | $Mg_{70}Cu_{15}Ni_5Ag_{10}$ | — | — | Crystalline |

FIGS. 6 to 10 show the results of analysis for the specimen having the example and comparison example compositions, which are listed in Table 3.

Figure 6:
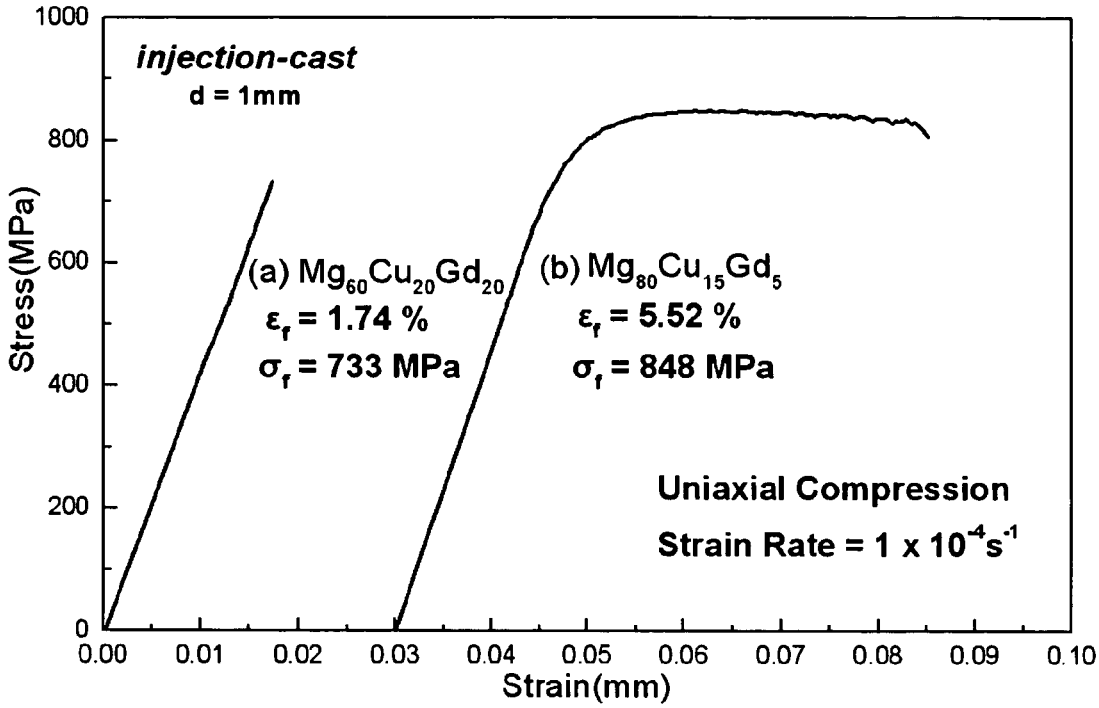
FIG. 6 is a plot of stress versus strain obtained through a compression test for (b) the example 18 of the invention and (a) the comparison example 7.

FIG. 6 is a plot of stress versus strain obtained through a compression test for (b) the example 18 of the invention and (a) the comparison example 7.

As can be seen from the curve b of FIG. 6, the example 18 ($Mg_{80}Cu_{15}Gd_5$) has a high strength of 848 MPa, which corresponds to three times of the compressive strength (200~300 MPa) of common crystalline Mg alloys, and exhibits a fracture elongation of 5.52%.

In contrast, as can be seen in the plot (a) of FIG. 6, the comparison example 7 ($Mg_{60}Cu_{20}Gd_{20}$) has a relatively good strength (733 MPa), as compared with crystalline Mg alloys, but exhibits a brittle fracture behavior without plastic deformation after the elastic range thereof. Thus, it can be understood from these results that the alloy design of the invention, i.e., an increase in the Mg content so as to have the ductile property of crystalline Mg alloys leads to an improvement in the mechanical properties, in particular the plastic elongation rate.

Figure 7:
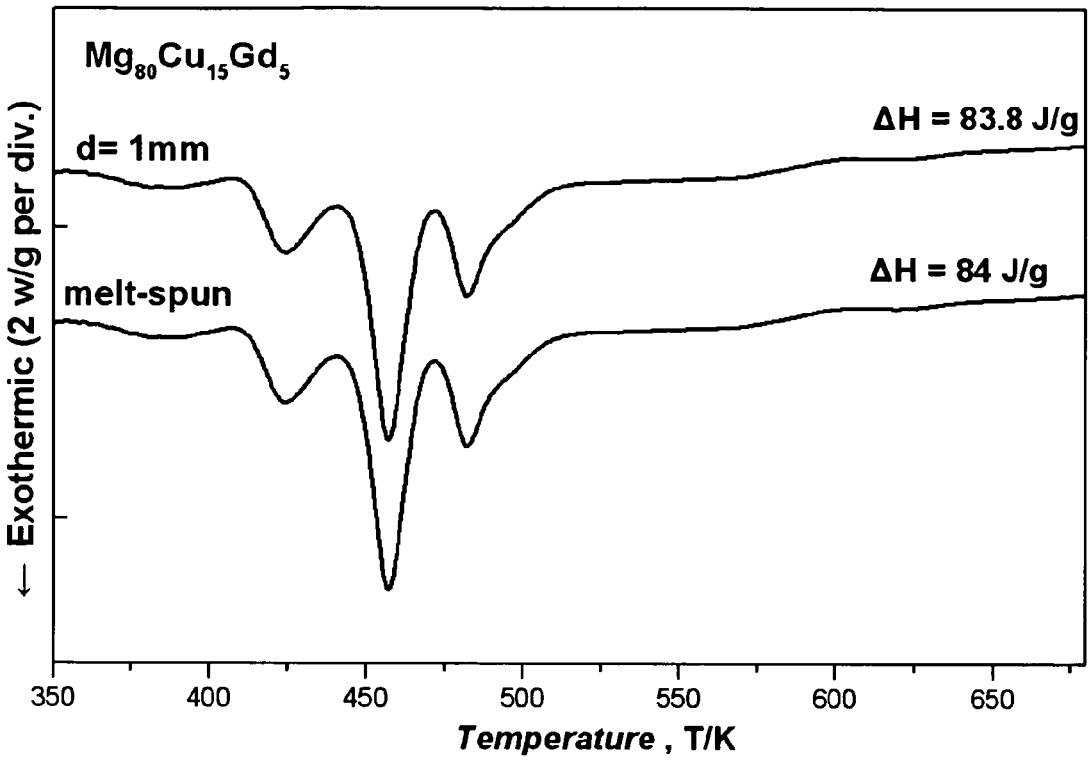
FIG. 7 shows the result of a differential thermal analysis for the example 18 ($Mg_{80}Cu_{15}Gd_5$) of the invention.

FIG. 7 shows the result of a differential thermal analysis for the example 18 ($Mg_{80}Cu_{15}Gd_5$) of the invention. As shown in FIG. 7, the example 18 of the invention has a similar thermal behavior in both the melt-spun ribbon-type amorphous alloy and the bulk amorphous alloy (d=1 mm), in particular, a similar value in AH, which indicates the heat generated during crystallization.

The above experimental result means that the example 18 constitutes a single-phase of amorphous alloy, in spite of the higher content of magnesium.

Figure 8:
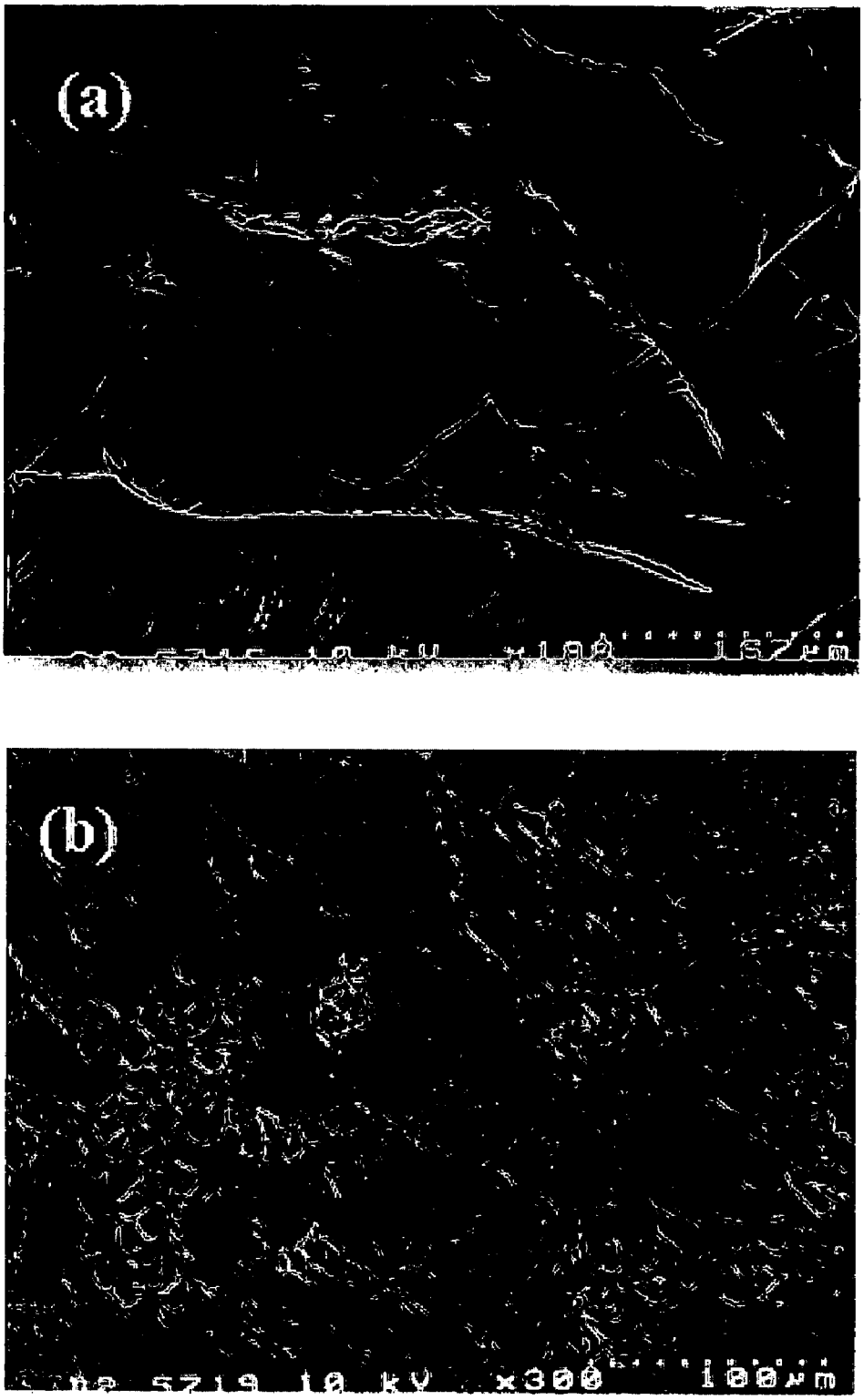
FIG. 8 is a SEM photograph of rupture surfaces after fractured respectively for (b) the example 18 of the invention and (a) the comparison example 7.

FIG. 8 is a SEM photograph of rupture surfaces after fractured respectively for (b) the example 18 of the invention and (a) the comparison example 7.

The photo (a) in FIG. 8 shows a typical brittle fracture surface of a conventional Mg-based amorphous alloy. In contrast, the photo (b) of FIG. 8 shows a ductile fracture image of vein pattern formed through plastic deformation, where the amorphous alloy is partially melted and re-solidified due to heat generated by rupture-resistance and the low melting point of the alloy of the invention.

In other words, it is known that, if a stress is concentrated in a certain portion of an amorphous alloy, the concentrated stress is alleviated, forming a shear band within the alloy. Thus, in order that an amorphous alloy exhibits a better plastic deformation characteristic, multiple shear bands are to be formed. When fractured after plastic deformation, the residual stress alleviated during the plastic deformation is instantly changed into heat, which is then discharged.

In addition, amorphous alloys exhibit a viscous flow behavior at elevated temperature, and thus vein patterns are formed in the fracture surface, during a viscous deformation at the elevated temperature caused by an instantaneous exothermic heat. Particularly, in case of the amorphous alloy of the invention having a low melting point, when fractured, the fracture surface thereof is instantaneously melted due to the instant exothermic heat energy and then re-solidified, thereby easily forming the vein pattern in the rupture surface thereof.

The above vein pattern and the traces of melting in the surface prevail much more when the alloy exhibits a plastic deformation behavior under compressive stress, where the material sustains the compressive stress. Conversely, after compression of an amorphous material, these features in the fracture surface thereof indicate that the material has undergone a plastic deformation.

These results mean that the amorphous alloy according to the example 18 of the invention has a good ductility, dissimilar to the conventional Mg-based amorphous alloys.

Figure 9:
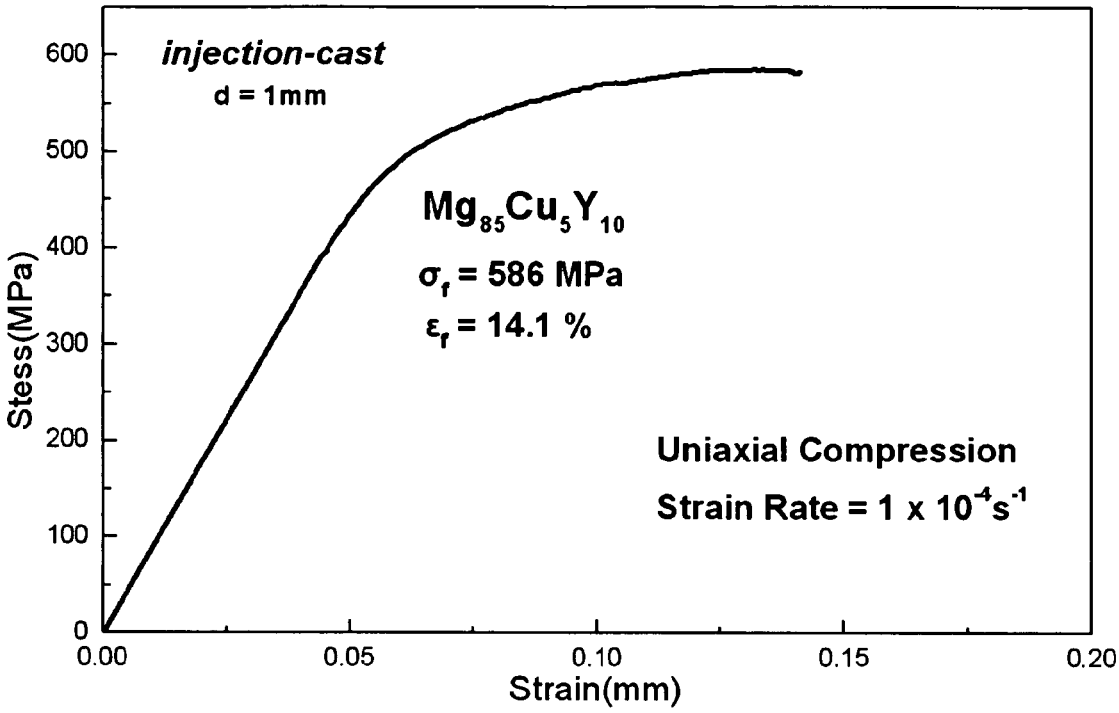
FIG. 9 is a plot of stress versus strain obtained through a compression test for the example 25 of the invention.

FIG. 9 is a plot of stress versus strain obtained through a compression test for the example 25 of the invention ($Mg_{85}Cu_5Y_{10}$).

As shown in FIG. 9, the example 25 of the invention has a high strength of 586 MPa, which corresponds to around twice of the compressive strength (200~300 MPa) of crystalline Mg-base alloys, and in particular, exhibits a fracture elongation of 14.1%, dissimilar to the brittle fracture behavior of the conventional Mg-based amorphous alloys.

Figure 10:
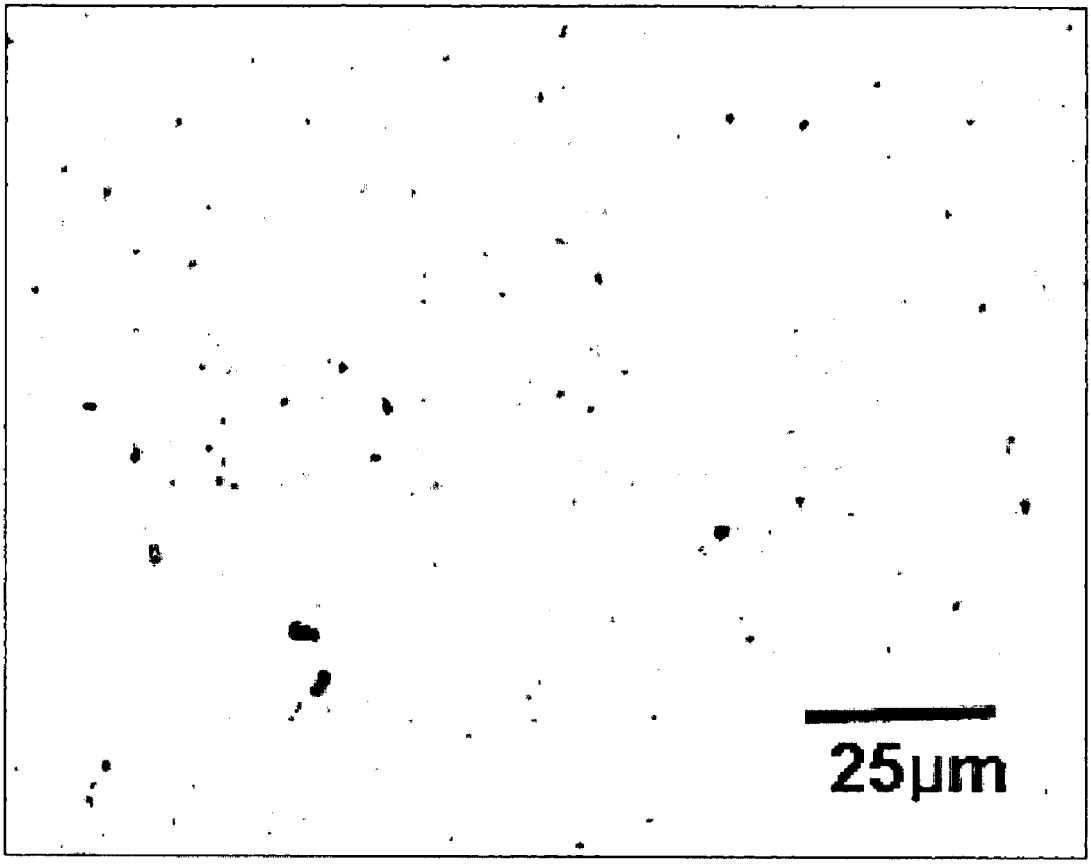
FIG. 10 is an optical micrograph for the example 25 of the invention.

FIG. 10 is an optical micrograph for the example 25 of the invention.

As can be seen from FIG. 10, the example 25 of the invention exhibits a composite-like form, where a competitive crystalline phase related to the amorphous formation is uniformly mixed in a Mg-based amorphous matrix.

In other words, under the competitive situation between the stability of liquid phase and the formation of crystalline phase in common-type amorphous alloys, the formation of amorphous phase is more favorable if the liquid phase is more stable, and the entire alloy system is solidified into a crystalline phase if the competitive crystalline phase is more stable. In case of the example 25 of the invention, as shown in FIG. 10, while the amorphous phase is formed under the given cooling speed, partially a competitive crystalline phase is formed together (in-situ composite).

The above result is totally different from those provided with a plastic deformation property through the conventional techniques, in which other elements are added to the conventional Mg-based or common-type amorphous alloy compositions (ex-situ composite), or a ceramic material or the like is mixed therewith to form a composite material.

In the example 25 shown in FIG. 10, a stable amorphous phase (the gray area in FIG. 10) is formed at the given cooling speed, and formation of competitive crystalline phases (dark spots in FIG. 10) is occurred partially, thereby providing a good plastic deformation characteristic.

As described above, the Mg-base amorphous alloy of the invention can be manufactured in a bulk amorphous form through a die casting process in the air atmosphere. Thus, expensive vacuum equipment and high level of vacuum control are not necessitated, thereby enabling an easy commercialization.

In addition, the Mg-based bulk amorphous alloy of the invention, which is manufactured through a conventional die casting process, has an improved compressive strength of above 800 MPa, and thus can provide a greater possibility of being used as a structural material.

Furthermore, at the boundary composition between the amorphous forming composition range and non-forming range, a competitive crystalline phase is partially precipitated. Thus, non-uniformity is occurred within the alloy without adding other elements, thereby providing a plastic deformation characteristic at room temperature. Consequently, the Mg-based amorphous alloy has a high strength and an improved ductility, and thus exhibits a good resistance to fracture under stresses beyond the elastic limit thereof.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A magnesium based amorphous alloy having a glass forming ability and ductility, the alloy consisting of a composition of $Mg_{100-x-y}A_xB_y$, where x and y are respectively $5 \leqq x \leqq 30$ and $2.5 \leqq y \leqq 20$ in atomic percent, wherein A includes Ag present in at least 2.5 atomic percent and Cu, and B is Gd.

2. The amorphous alloy as claimed in claim 1, wherein the amorphous alloy is capable of being manufactured in a bulk amorphous form, using a die casting process, an injection casting process, or a high-pressure squeeze casting in an air atmosphere.

* * * * *